US005636691A

United States Patent [19]

Hendrickson et al.

[11] Patent Number: 5,636,691

[45] Date of Patent: Jun. 10, 1997

[54] ABRASIVE SLURRY DELIVERY APPARATUS AND METHODS OF USING SAME

[75] Inventors: James D. Hendrickson, Carrollton, Tex.; Dean S. O'Neal, Lafayette, La.; Sidney J. Guillot, St. Martinville, La.; Ronnie D. Finley, New Iberia, La.

[73] Assignee: Halliburton Energy Services, Inc., Dallas, Tex.

[21] Appl. No.: 529,769

[22] Filed: Sep. 18, 1995

[51] Int. Cl.[6] ..... E21B 43/04

[52] U.S. Cl. ..... 166/278; 166/51; 166/222; 166/242.1

[58] Field of Search ..... 166/278, 51, 222, 166/242.1

[56] References Cited

U.S. PATENT DOCUMENTS

| | | | |
|---|---|---|---|
| 2,224,538 | 12/1940 | Eckel et al. | 166/222 X |
| 2,297,308 | 9/1942 | Layne | 166/51 |
| 3,960,366 | 6/1976 | Abney et al. | 166/51 X |
| 4,049,055 | 9/1977 | Brown | 166/278 |
| 4,726,419 | 2/1988 | Zunkel | 166/51 |
| 4,921,044 | 5/1990 | Cooksey | 166/116 |

FOREIGN PATENT DOCUMENTS

| | | | |
|---|---|---|---|
| 94/03704 | 2/1994 | WIPO | 166/278 |

*Primary Examiner*—Hoang C. Dang
*Attorney, Agent, or Firm*—William M. Imwalle; J. Richard Konneker

[57] ABSTRACT

An abrasive slurry delivery apparatus and associated method of using permit repeated and/or extended use of the apparatus in a subterranean wellbore and reduces abrasive wear of the casing during fracturing operations without requiring the disposal of expensive items of equipment after each fracturing operation. In a preferred embodiment, an abrasive slurry delivery apparatus has a tubular crossover member with an internal flow passage and side wall outlet openings, and a tubular protective member with outlet openings aligned with, but axially and circumferentially smaller than, the crossover outlet openings, coaxially disposed within the crossover.

38 Claims, 9 Drawing Sheets

ABRASIVE SLURRY DELIVERY APPARATUS AND METHODS OF USING SAME

BACKGROUND OF THE INVENTION

The present invention relates generally to tools used in subterranean wells and, in a preferred embodiment thereof, more particularly provides a slurry delivery apparatus for use in formation fracturing operations.

Oftentimes, a potentially productive geological formation beneath the earth's surface contains a sufficient volume of valuable fluids, such as hydrocarbons, but also has a very low permeability. "Permeability" is a term used to describe that quality of a geological formation which enables fluids to move about in the formation. All potentially productive formations have pores, a quality described using the term "porosity", within which the valuable fluids are contained. If, however, the pores are not interconnected, the fluids cannot move about and, thus, cannot be brought to the earth's surface.

When such a formation having very low permeability, but a sufficient quantity of valuable fluids in its pores, is desired to be produced, it becomes necessary to artificially increase the formarion's permeability. This is typically accomplished by "fracturing" the formation, a practice which is well known in the art and for which purpose many methods have been conceived. Basically, fracturing is achieved by applying sufficient pressure to the formation to cause the formation to crack or fracture, hence the name. The desired result being that the cracks interconnect the formarion's pores and allow the valuable fluids to be brought out of the formation and to the surface.

A conventional method of fracturing a formation begins with drilling a subterranean well into the formation and cementing a protective tubular casing within the well. The casing is then perforated to provide fluid communication between the formation and the interior of the casing which extends to the surface. A packer is set in the casing to isolate the formation from the rest of the wellbore, and hydraulic pressure is applied to the formation via tubing which extends from the packer to pumps on the surface.

The pumps apply the hydraulic pressure by pumping fracturing fluid down the tubing, through the packer, into the wellbore below the packer, through the perforations, and finally, into the formation. The pressure is increased until the desired quality and quantity of cracks is achieved and maintained. Much research has gone into discerning the precise amount and rate of fracturing fluid and hydraulic pressure to apply to the formation to achieve the desired quality and quantity of cracks.

The fracturing fluid's composition is far from a simple matter itself. Modern fracturing fluids may include sophisticated manmade proppants suspended in gels. "Proppant" is the term used to describe material in the fracturing fluid which enters the formation cracks once formed and while the hydraulic pressure is still being applied (that is, while the cracks are still being held open by the hydraulic pressure), and acts to prop the cracks open. When the hydraulic pressure is removed, the proppant keeps the cracks from closing completely. The proppant thus helps to maintain the artificial permeability of the formation after the fracturing job is over. Fracturing fluid containing suspended proppant is also called a slurry.

A proppant may be nothing more than a very fine sand, or it may be a material specifically engineered for the job of holding formation cracks open. Whatever its composition, the proppant must be very hard and strong to withstand the forces trying to close the formation cracks. These qualities also make the proppant a very good abrasive. It is not uncommon for holes to be formed in the protective casing, tubing, pumps, and any other equipment through which a slurry is pumped.

Particularly susceptible to abrasion wear from pumped slurry is any piece of equipment in which the slurry must make a sudden or significant change in direction. The slurry, being governed by the laws of physics, including the principles of inertia, tends to maintain its velocity and direction of flow, and resists any change thereof. An object in the flowpath of the slurry which tends to change the velocity or direction of the slurry's flow will soon be worn away as the proppant in the slurry incessantly impinges upon the object.

Of particular concern in this regard is the piece of equipment attached to the tubing extending below the packer which takes the slurry as it is pumped down the tubing and redirects it radially outward so that it exits the tubing and enters the formation through the perforations. That piece of equipment is called a crossover. Assuming, for purposes of convenience, that the tubing extends vertically through the wellbore, and that the formation is generally horizontal, the crossover must change the direction of the slurry by ninety degrees. Because of this significant change of direction, few pieces of equipment (with the notable exception of the pumps) must withstand as much potential abrasive wear as the crossover.

In addition, the crossover is frequently called upon to do several other tasks while the slurry is being pumped through it. For example, the crossover typically contains longitudinal circulation ports through which fracturing fluids that are not received into the formation after exiting the crossover are transmitted back to the surface. Space limitations in the wellbore dictate that the circulation ports are not far removed from the flowpath of the slurry through the crossover. If the crossover is worn away such that the slurry flowpath achieves fluid communication with the circulation ports in the crossover, the fracturing job must cease. Once stopped, the frac job cannot be recommenced or completed. Hence, it is very important that the crossover does not fail while the job is in process. If the frac job is not halted after the crossover fails, the slurry will enter the circulation ports in the crossover and travel back to the surface without delivering the proppant to the formation.

For the above reasons and others, the crossover has commonly been considered a disposable piece of equipment, usable for only one fracturing job, or worse, less than one fracturing job. Even when it survives a fracturing job, it is usually sufficiently worn that no further use may be made of it. This is unfortunate because the crossover is also typically one of the most expensive pieces of equipment used in a fracturing job due to its high machining and material costs.

Further, customers are now demanding fracturing jobs with high flow rates, high pressures, higher quantities, and higher density proppants. All of these increase wear on the crossover and thereby increase the likelihood of crossover failure during the fracturing job.

Attempts have been made to provide a solution for these problems. One involves making the crossover out of extremely hard and abrasion wear resistant materials. This has proven to reduce the rate of abrasion wear of the crossover. It is, however, enormously expensive to make an entire crossover out of a sufficiently wear resistant material. No economic advantage is actually achieved by this solution over the disposable crossover made of less wear resistant, but much less expensive, materials.

Another proposed solution is to utilize surface treatment of less expensive alloy steels to achieve a wear resistant crossover surface. Methods such as carburizing, nitriding, etc., which produce a high surface hardness do indeed slow the abrasion wear rate of the crossover at less expense than using exotic materials. However, as soon as the hardened surface layer has been breached, the crossover begins to wear away rapidly. For this reason, surface-hardened crossovers are also not sufficiently durable for the newer high flow, high pressure fracturing jobs. The extra expense of surface-hardening a disposable crossover makes this solution uneconomical as well.

Another area of concern in regard to abrasion wear during fracturing jobs is the protective casing lining the wellbore. Since the crossover typically directs the slurry flow radially outward, the casing is directly in the altered slurry flowpath. Unintended, misplaced holes in the casing are to be avoided, since it is the casing which provides the only conduit extending to the surface through which all other conduits and equipment must pass.

From the foregoing, it can be seen that it would be quite desirable to provide a slurry delivery apparatus which does not have the economic disadvantages of the solutions enumerated above, but which allows repeated use thereof. It would also be desirable to provide a slurry delivery apparatus which minimizes the abrasive wear of the casing during fracturing operations. It is accordingly an object of the present invention to provide such a slurry delivery apparatus and associated methods of using same.

SUMMARY OF THE INVENTION

In carrying out the principles of the present invention, in accordance with an embodiment thereof, an abrasive slurry delivery apparatus and method of using same are provided, which apparatus and method are specially adapted for utilization in formation fracturing operations in subterranean wellbores.

In broad terms, an abrasive slurry delivery apparatus is provided which includes a first tubular structure having an internal flow passage through which a pressurized, abrasive slurry material may be axially flowed in a downstream direction, and an axial portion having a side wall section with an outlet opening therein through which an abrasive slurry material may be outwardly discharged from the internal flow passage, the outlet opening being circumscribed by a peripheral edge portion of the side wall section, and protective means for shielding the peripheral edge portion of the side wall section from abrasive slurry material being discharged outwardly through the outlet opening, the protective means being disposed within the axial portion of the first tubular structure and having a peripheral edge portion that inwardly overlaps the peripheral edge portion of the side wall section and inwardly blocks a peripheral portion of the outlet opening.

An abrasive slurry delivery apparatus operatively positionable in a subterranean wellbore is also provided, the apparatus including a first tubular structure having an internal flow passage through which a pressurized, abrasive slurry material may be axially flowed in a downstream direction, the first tubular structure having an axial portion with a side wall section thereon, first opening means, associated with the first tubular structure side wall section and operative to discharge abrasive slurry material from the internal flow passage outwardly from the first tubular structure, a second tubular structure coaxially and outwardly circumscribing the axial portion of the first tubular structure and forming therewith an annular flow passage that circumscribes the axial portion, the second tubular structure having a side wall section spaced apart from the first opening means in the downstream direction, and second opening means formed in the second tubular structure side wall section, the annular flow passage and the second opening means cooperating to cause abrasive slurry being outwardly discharged from the first opening means to flow in a downstream direction through the annular flow passage before being discharged outwardly through the second opening means.

Also provided is an abrasive slurry delivery apparatus operatively positionable in a subterranean wellbore, including a first tubular structure having an internal flow passage through which a pressurized, abrasive slurry material may be axially flowed in a downstream direction, and an axial portion having a side wall section with a circumferentially spaced plurality of axially elongated first outlet slots disposed therein and through which an abrasive slurry material may be outwardly discharged from the internal flow passage, each of the first outlet slots having upstream and downstream ends and being circumscribed by a peripheral edge portion of the side wall section, a tubular protective sleeve coaxially and replaceably supported in the axial portion of the first tubular structure and having a circumferentially spaced plurality of axially elongated second outlet slots disposed therein and generally aligned with the first outlet slots, the second outlet slots being smaller than the first outlet slots and being bounded by side wall peripheral edge portions that inwardly overlap the peripheral edge portions of the first tubular structure side wall section, whereby the side wall peripheral edge portions of the tubular protective sleeve inwardly shield the peripheral edge portions of the first tubular structure side wall section from impingement by abrasive slurry material being discharged through the first outlet slots.

For use in conjunction with an abrasive slurry delivery structure having a first tubular structure with an internal passage through which an abrasive slurry may be axially flowed in a downstream direction, and side wall outlet opening means bounded by a peripheral side wall edge portion and outwardly through which abrasive slurry material from the internal passage may be discharged, a method of inhibiting slurry erosion of the peripheral side wall edge portion is provided, the method including the steps of providing a replaceable protective member having a peripheral edge portion, and removably positioning the protective member within the interior of the first tubular structure in a manner such that the peripheral edge portion of the protective member shields the peripheral side wall edge portion of the first tubular structure outlet opening means from abrasive slurry material being forced outwardly therethrough and is subjected to slurry abrasion in place of the peripheral side wall edge portion of the first tubular structure outlet opening means.

A method of delivering abrasive slurry material to the interior of a subterranean wellbore is also provided, the method including the steps of positioning in the wellbore a slurry delivery assembly having a first tubular structure having an internal passage through which an abrasive slurry material may be axially forced in a downstream direction, the first tubular structure having first side wall opening means communicating with the internal passage and through which pressurized abrasive slurry material may be outwardly discharged from the internal passage, and a second tubular structure coaxially and outwardly circumscribing the first tubular structure and forming therearound an annular flow passage, the second tubular structure having second side wall opening means positioned downstream from the first side wall opening means, and forcing a pressurized abrasive slurry sequentially through the internal passage in the downstream direction, outwardly through the first side wall opening means into the annular flow passage, axially through the annular flow passage in the downstream direction, and then outwardly through the second side wall outlet means.

The disclosed slurry delivery apparatus and method of using same permit fracturing operations to be performed more economically and with less damage to equipment disposed within a wellbore and the wellbore casing, as well as at high flow rates, high pressures, high quantities, and high proppant densities, without failure.

DETAILED DESCRIPTION

Figure 1:
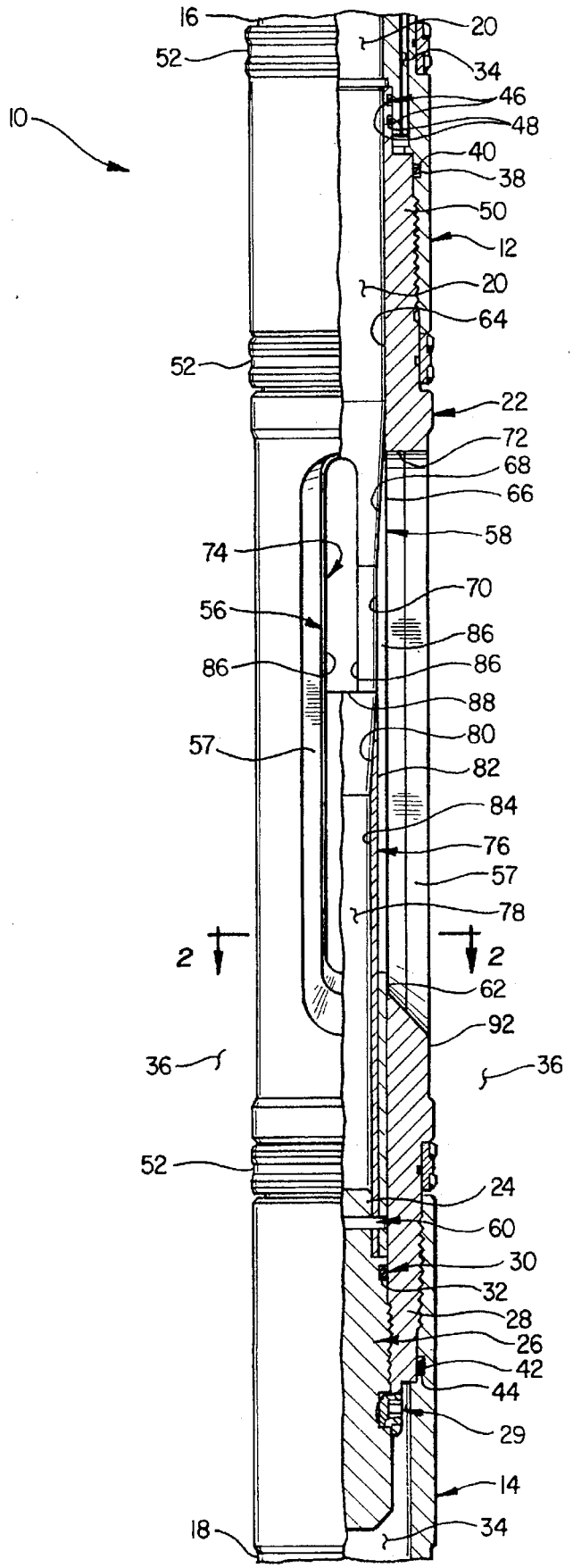
FIG. 1 is a partially cross-sectional view of a slurry delivery apparatus having a crossover, a tubular protective sleeve, and a tubular sacrificial insert therein embodying principles of the present invention.

Illustrated in FIG. 1 is an abrasive slurry delivery apparatus 10 which embodies principles of the present invention. In the following detailed description of the apparatus 10 representatively illustrated in FIG. 1 and subsequent figures described hereinbelow, directional terms such as "upper", "lower", "upward", "downward", etc. will be used in relation to the apparatus 10 as it is depicted in the figures. It is to be understood that the apparatus 10 may be utilized in vertical, horizontal, inverted, or inclined orientations without deviating from the principles of the present invention.

Figure 10:
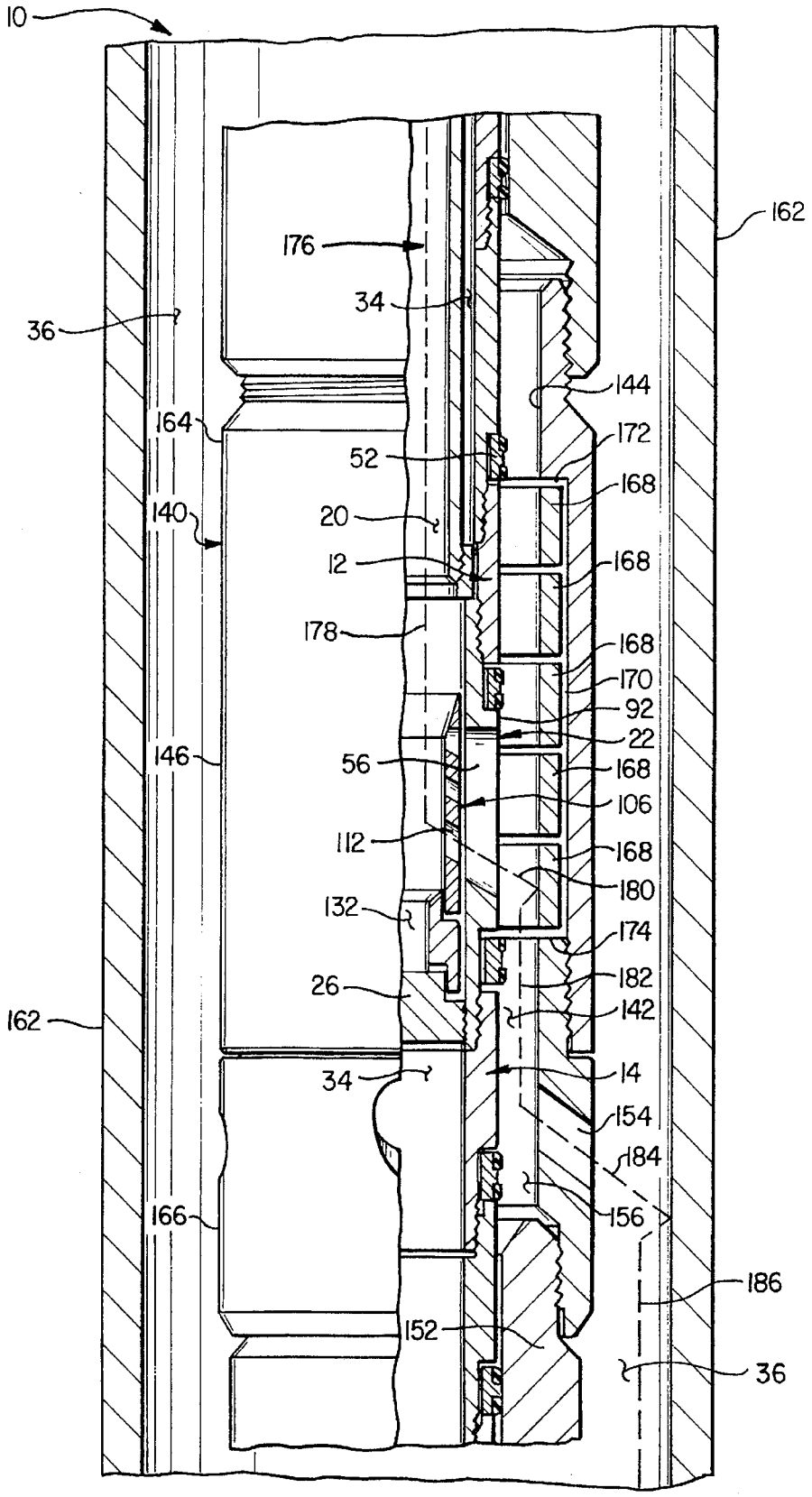
FIG. 10 is a highly schematicized partially cross-sectional view of the slurry delivery apparatus having another casing protective flow sub and operatively disposed within a portion of protective casing.

Apparatus 10, as representatively illustrated in FIG. 1, is specially adapted for use within a tool string known to those skilled in the art as a service tool string (not shown), which is suspended from tubing extending to the earth's surface, the tubing being longitudinally disposed within protective casing in a subterranean wellbore (see FIG. 10). The service tool string is typically inserted through a packer (not shown) during a fracturing job. A pressurized, abrasive slurry is then pumped through the tubing and into the service tool string. Tubular upper connector 12 and lower connector 14 permit interconnection of the apparatus 10 into the service tool string. Accordingly, upper portion 16 of upper connector 12 is connected to the service tool string above the apparatus 10, and lower portion 18 of lower connector 14 is connected to the remainder of the service tool string extending below the apparatus.

Axial flow passage 20 extends longitudinally (i.e., axially) downward from the upper portion 16 of upper connector 12, axially through the upper connector, and into a generally tubular crossover 22. The axial flow passage 20 terminates at upper radially reduced portion 24 of generally cylindrical plug 26. Plug 26 is threadedly installed into lower portion 28 of crossover 22 and secured with a pair of set screws 29 (only one of which is visible in FIG. 1). Sealing engagement between the plug 26 and the lower portion 28 of crossover 22 is provided by seal 30 disposed in circumferential groove 32 externally formed on the plug.

Radially displaced, longitudinally extending, circulation flow passage 34 extends downwardly from upper portion 16, through the upper connector 12, longitudinally through the crossover 22 in a manner that will be described more fully hereinbelow, through the lower connector 14, and to lower portion 18. When operatively installed in a wellbore 36, the circulation flow passage 34 in the apparatus 10 is sealingly isolated from the wellbore external to the apparatus by seal 38 disposed in circumferential groove internally formed on the upper connector 12, and by seal 42 disposed in circumferential groove 44 internally formed on the lower connector 14. The circulation flow passage 34 is sealingly isolated from coaxial flow passage 20 in the apparatus 10 by seal 30, and by a pair of seals 46, each disposed in one of a pair of circumferential grooves 48 externally formed on an upper portion 50 of the crossover 22 which extends coaxially into the upper connector 12.

Annular antifriction seal rings 52 are disposed in longitudinally spaced apart external annular recesses 54 formed on upper portion 16 of upper connector 12, between upper connector 12 and crossover 22, and between crossover 22 and lower connector 14. The antifriction seal rings 52 ease insertion and movement of the apparatus 10 within the packer and other equipment into which the apparatus 10 may be longitudinally disposed, as well as providing an effective seal therebetween.

Upper portion 50 of crossover 22 is threadedly attached to upper connector 12, and lower portion 28 of the crossover is threadedly attached to lower connector 14.

Four longitudinally extending circumferentially spaced apart slotted outlet openings or exit ports 56 (three of which are visible in FIG. 1), having external radially extending and circumferentially sloping surfaces 57 formed thereon, provide fluid communication between the axial flow passage 20 and the wellbore 36. It is through these exit ports 56 that a slurry must pass in its transition from longitudinal flow in the axial flow passage 20 to radial flow into the wellbore 36. Because of the substantial change of direction from longitudinal flow to radial flow of the slurry through the exit ports 56, the exit ports are particularly susceptible to abrasion wear from proppant contained in the slurry.

In order to protect the exit ports 56 against abrasion wear, a tubular protective sleeve 58 is coaxially disposed within the crossover 22. The protective sleeve 58 is made of a suitably hard and tough abrasion resistant material, such as tungsten carbide, or is made of a material, such as alloy steel, which has been hardened. If made of an alloy steel, the protective sleeve 58 is preferably through-hardened by a process such as case carburizing or nitriding. Other materials and hardening methods may be employed for the protective sleeve 58 without deviating from the principles of the present invention. Tests performed by the applicants indicate that the protective sleeve 58 is preferably made of tungsten carbide.

The protective sleeve 58 is secured into the crossover 22 by drive pin 60 which extends laterally through the protective sleeve and the upper portion 24 of the plug 26. Outer diameter 62 of protective sleeve 58 is only slightly smaller than inner diameter 64 of crossover 22 to prevent the slurry from flowing between the protective sleeve and the crossover. Alternatively, the protective sleeve 58 outer diameter 62 may be slightly larger than the crossover 22 inner diameter 64 such that a press fit or shrink fit is obtained between them.

Upper portion 66 of protective sleeve 58 extends axially upward past the exit ports 56 in the crossover 22, thereby completely internally overlapping that portion of the crossover 22 in which the exit ports 56 are located. Internal longitudinally extending and radially sloping transition surface 68 formed in the upper portion 66 of protective sleeve 58 provides a smooth transition between the inner diameter 64 in the upper portion 50 of the crossover 22 and radially reduced inner diameter 70 of the protective sleeve 58. Note that transition surface 68 extends radially opposite and longitudinally across upper end surfaces 72 of exit ports 56.

Four longitudinally extending and circumferentially spaced slotted outlet openings or flow ports 74 (three of which are visible in FIG. 1) formed in the protective sleeve 58 are circumferentially aligned with the exit ports 56 in the crossover 22. Flow ports 74 are each slightly smaller in length and width than exit ports 56. Thus, flow ports 74 do not permit direct impingement of the slurry on the crossover 22 as it flows radially from the axial flow passage 20 and into the wellbore 36.

Coaxially disposed within the protective sleeve 58 is a tubular sacrificial insert 76, the purpose of which is described more fully hereinbelow. The insert 76 is secured to the upper portion 24 of the plug 26 radially intermediate the plug and the protective sleeve 58. The insert 76 extends longitudinally upward from the plug 26 to a location somewhat downward from transition surface 68 of the protective sleeve 58.

An upwardly opening interior hollow cylindrical volume within the insert 76 above the upper portion 24 of the plug 26 forms a slurry well 78. An internal longitudinally extending and radially sloped transition surface 80 formed in an upper portion 82 of the insert 76 smooths the transition between the inner diameter 70 of the protective sleeve 58 to inner diameter 84 of the insert. As the slurry flows longitudinally downward through the coaxial flow passage 20 into the crossover 22, the slurry will enter the well 78 through its upwardly facing open upper portion 82 and quickly fill the well. Thereafter, the downwardly flowing slurry will directly impinge on the portion of the slurry which has filled the well 78, effectively preventing the slurry from abrading any portion of the crossover 22, protective sleeve 58, or insert 76 due to direct longitudinal impingement by the slurry.

However, as the slurry flow changes direction from longitudinal to radial near the upper portion 82 of the insert 76, abrasion from the slurry flow will gradually wear away the insert. This wearing away of the insert 76 is intended, and the material of which the insert is made is selected to regulate the rate at which the insert wears away. For most applications, the insert 76 is preferably made of brass. The insert 76 may also be made of a more easily abraided material such as aluminum, or a less easily abraided material such as mild steel, to regulate its wear rate without deviating from the principles of the present invention. Preferably, the material of which the insert 76 is made should be selected such that the insert wears longitudinally downward, gradually exposing more of the protective sleeve 58 to the radially directed flow of the slurry, such that the flow ports 74 of the protective sleeve 58 are not permitted to wear circumferentially outward sufficiently far to expose the exit ports 56 of the crossover 22 to the radially directed flow of the slurry.

Through extensive testing, the applicants have determined that the flow ports 74 of the protective sleeve 58 wear at a greater rate at a portion of the flow ports 74 exposed to the radially directed slurry flow which is most longitudinally downward. Thus, in the apparatus 10 as representatively illustrated in FIG. 1, portions 86 of the protective sleeve 58 will have the greatest rate of wear. This is because portions 86 are the portions of the protective sleeve 58 exposed to the radially directed slurry flow which are most longitudinally downward disposed.

Testing has also revealed that with longitudinally extending and circumferentially spaced apart slotted ports such as the flow ports 74 in the protective sleeve 58, the high wear rate portions 86 extend longitudinally approximately 1.5 inches. For this reason, upper edge 88 of the insert 76 is longitudinally spaced downward from the transition surface 68 on the protective sleeve 58 approximately 1.5 inches, thereby preventing excessive wear of the transition surface 68 (where radial thickness of the protective sleeve 58 is minimal) and upper portion 66 of the protective sleeve. Note that the longitudinal extent of high wear rate portions 86 may vary depending on factors such as slurry flow rate and flow port 74 width and number of flow ports. The longitudinal distance between the upper edge 88 of the insert 76 and the transitional surface 68 of the protective sleeve B8 may be varied without deviating from the principles of the present invention.

It may now be fully appreciated that the insert 76 acts to effectively "spread" the circumferential wear of the flow ports 74 longitudinally downward as the insert 76 wears longitudinally downward within the protective sleeve 58. This is due to the fact that as the insert 76 wears longitudinally downward a gradually increasingly downward portion of the flow ports 74 is exposed to the radially directed slurry flow. In other words, high wear rate portions 86 gradually move longitudinally downward as insert 76 wears longitudinally downward. This unique interaction of the insert 76 with the protective sleeve 58 acts to prolong the useful life of the protective sleeve.

Thus has been described a unique configuration of slurry delivery apparatus 10, wherein the crossover 22 is protected from abrasion wear due to slurry flow by an abrasion resistant protective sleeve 58 and sacrificial insert 76, the insert acting to prolong the useful life of the protective sleeve by "spreading" abrasion wear of the protective sleeve over time so that the high wear rate portions 86 of the protective sleeve are continually displaced as the insert is worn away. The insert 76 additionally forms a slurry well 78, effectively minimizing abrasion wear due to longitudinally directed flow of the slurry. The protective sleeve 58 and sacrificial insert 76 are economical to manufacture and easily replaceable in the crossover 22.

Figure 2:
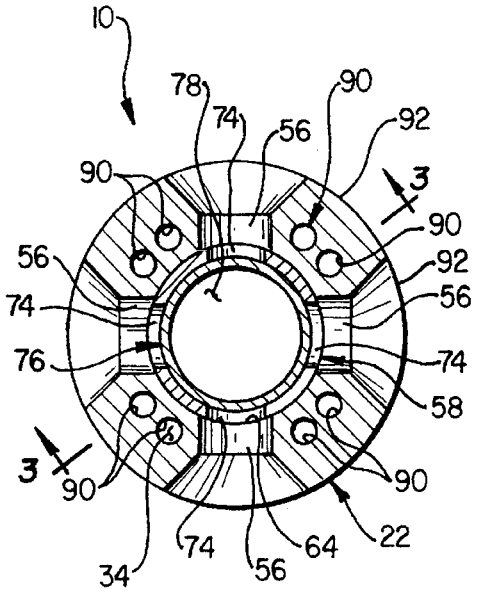
FIG. 2 is an enlarged scale cross-sectional view of the crossover of the slurry delivery apparatus, taken along line 2—2 of FIG. 1.

Turning now to FIG. 2, a cross-sectional view may be seen of the apparatus 10 representatively illustrated in FIG. 1. The cross-section is taken through line 2—2 of FIG. 1 which extends laterally through the crossover 22. In this view, the manner in which circulation flow passage 34 extends longitudinally through the crossover 22 may be seen.

Eight longitudinally extending and circumferentially spaced circulation ports 90 are disposed radially intermediate the inner diameter 64 of the crossover 22 and outer diameter 92 of the crossover. Two each of the circulation ports 90 are disposed in the crossover 22 circumferentially intermediate each pair of exit ports 56. Note that various quantities and locations may be chosen for the circulation ports 90 and the exit ports 56 in the crossover 22 without deviating from the principles of the present invention.

FIG. 2 also illustrates the necessity for preventing abrasion wear of the crossover 22. It may be clearly seen that if exit ports 56 are allowed to wear appreciably circumferentially outward, the exit ports 56 will eventually be in fluid communication with the circulation ports 90. It may also be clearly seen in FIG. 2 that flow ports 74 in protective sleeve 58, being somewhat smaller in width than the exit ports 56, act to protect the exit ports 56 from abrasion wear due to radially outwardly directed flow of the slurry.

Note that in this view protective sleeve 58 and insert 76 each completely internally overlap the inner diameter 64 of the crossover 22. Thus, the crossover 22 is not only protected against circumferentially outward wear of its exit ports 56, it is also protected against radially outward wear of its inner diameter 64.

Figure 3:
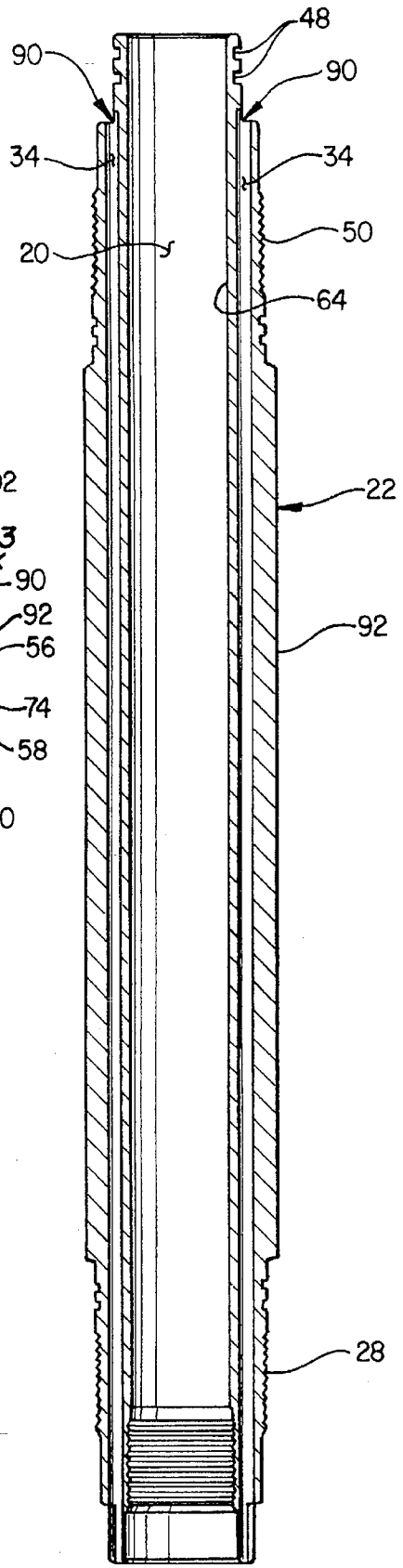
FIG. 3 is an enlarged scale cross-sectional view of the crossover of the slurry delivery apparatus, taken along line 3—3 of FIG. 2.

Turning now to FIG. 3, a cross-sectional view of the crossover 22, taken laterally along line 3—3 of FIG. 2 may be seen. For illustrative clarity, only the crossover 22 is shown in FIG. 3 and details of the exit ports 56 are not shown. FIG. 3 further illustrates the manner in which the circulation ports 90 are formed in the crossover 22.

Figures 4A, 4B:
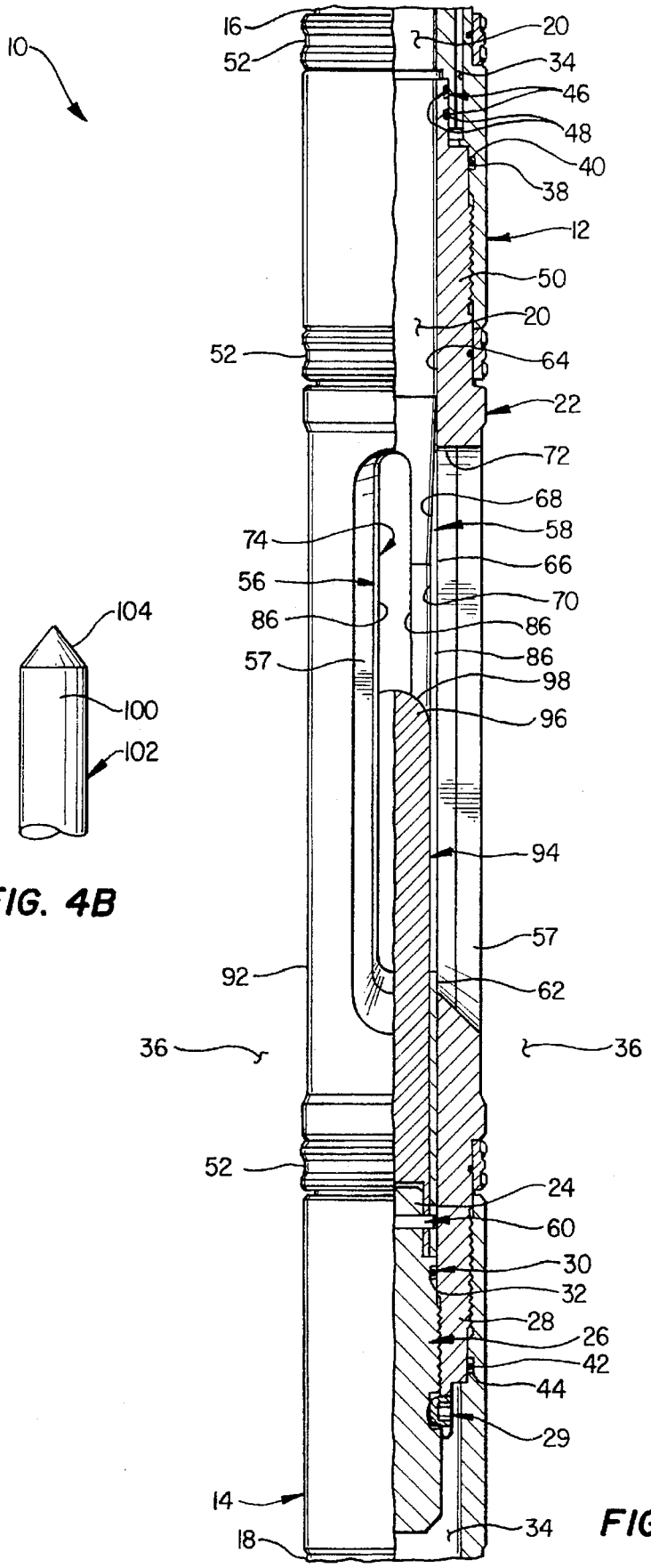
FIG. 4A is a partially cross-sectional view of the slurry delivery apparatus having a solid sacrificial insert therein.
FIG. 4B is an elevational view of a portion of an alternative solid sacrificial insert for use in the slurry delivery apparatus of FIG. 4A.

Illustrated in FIG. 4A is the slurry delivery apparatus 10 of FIG. 1, having an alternate substantially solid and generally cylindrical sacrificial insert 94 in place of the tubular insert 76. Note that, since insert 94 is substantially solid, there is no slurry well 78 therein. Lack of the slurry well 78, which acts to minimize abrasion wear due to longitudinally and downwardly directed slurry flow, is at least partially compensated for in insert 94 by its substantially greater amount of material which must be worn away.

An upper portion 96 of insert 94 has an upwardly facing spherical surface 98 formed thereon. Spherical surface 98 acts to direct the longitudinally downwardly directed slurry flow radially outward through the flow ports 74 of the protective sleeve 58.

Insert 94 is preferably made of a relatively harder and tougher material as compared to the material of which insert 76 is made to achieve a comparable wear rate. Insert 94 material selection depends on variables such as slurry flow rate, flow port 74 width and area, protective sleeve 58 material and wear rate, etc. Alternatively, insert 94 may be made of a material having a relatively soft core and relatively hard outer surface so that as the relatively soft core is worn away a slurry well is thereby formed in its place. It is to be understood that the material and any method of hardening used to make the insert 94 may be varied without departing from the principles of the present invention.

Illustrated in FIG. 4B is an upper portion 100 of a substantially solid and generally cylindrical sacrificial insert 102 which may be used alternatively in place of the insert 94 of FIG. 4A. A conically shaped upwardly protruding surface 104 formed on the upper portion 100 acts to direct the longitudinally downwardly directed slurry flow radially outward through the flow ports 74 of the protective sleeve 58. Thus, it is clearly seen that variously shaped upper portions of a substantially solid generally cylindrical sacrificial insert may be utilized without departing from the principles of the present invention.

Figure 5:
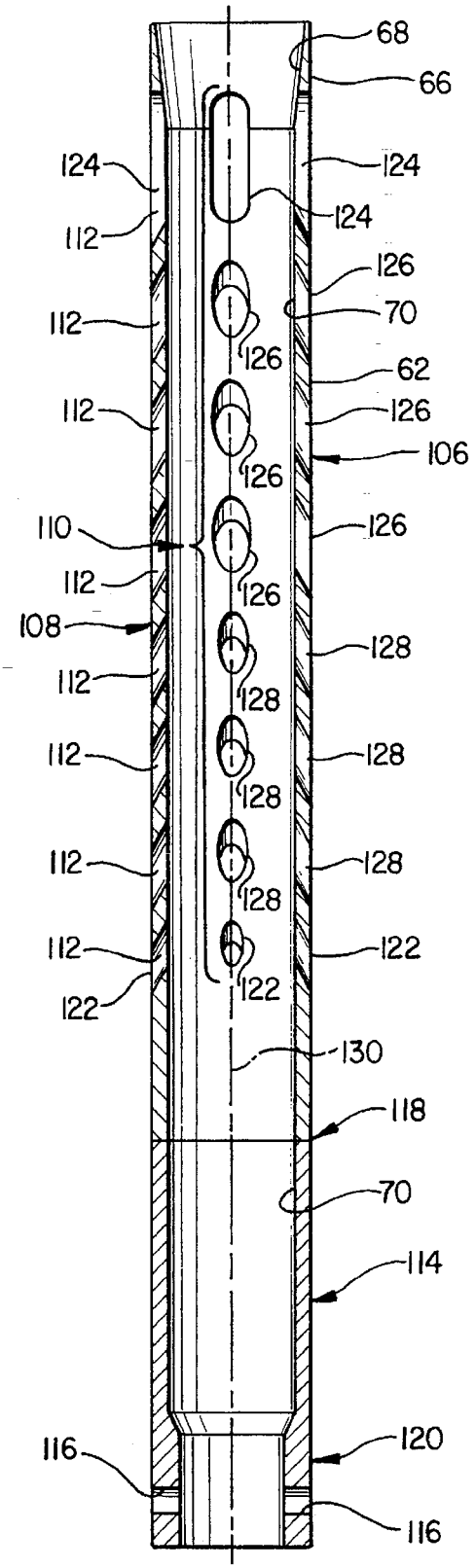
FIG. 5 is an enlarged scale cross-sectional view of another tubular protective sleeve for use in the slurry delivery apparatus.

FIG. 5 shows an alternative protective sleeve 106 for use in place of the protective sleeve 58 of FIG. 1. Due to a unique configuration thereof, protective sleeve 106 may be utilized in the slurry delivery apparatus 10 without a sacrificial insert disposed therein. The protective sleeve 106 representatively illustrated in FIG. 5 is specially configured for use without a sacrificial insert, although a sacrificial insert may be used with the protective sleeve without departing from the principles of the present invention.

A portion 108 of the protective sleeve 106 has four longitudinally extending and circumferentially spaced columns 110 composed of a series of axially spaced and variously shaped outlet openings or apertures 112 (only three of such columns of apertures being visible in FIG. 5). The columns 110 are aligned so that, when the protective sleeve 106 is operatively installed in the crossover 22, apertures 112 are disposed longitudinally and circumferentially within the exit ports 56 (see FIG. 6).

Figure 6:
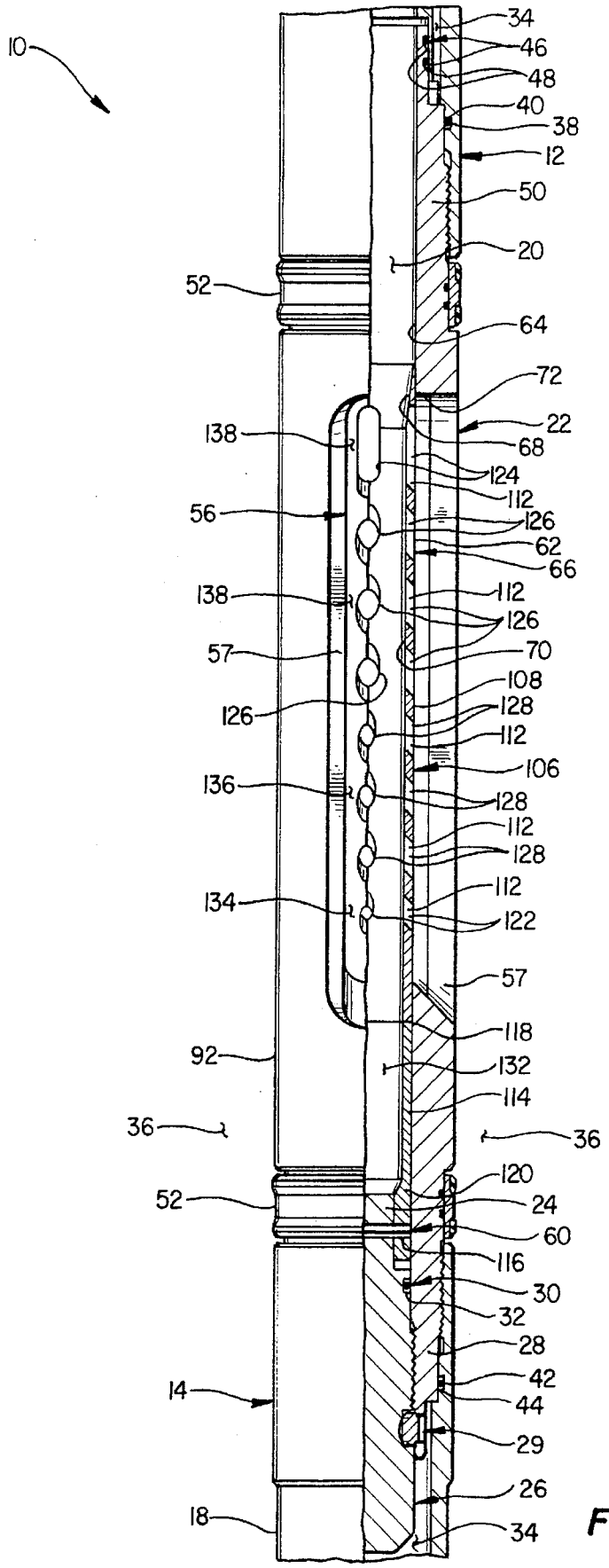
FIG. 6 is a partially cross-sectional view of the slurry delivery apparatus having the tubular protective sleeve of FIG. 5 operatively installed therein.

Lower portion 114 of the protective sleeve 106 is secured to upper portion 24 of the plug 26 by drive pin 60 which extends laterally through holes 116 (see FIG. 6). Lower portion 114 is secured to apertured portion 108 at interface 118 by a method such as welding. Lower portion 114 includes a portion 120 having a radially reduced inner diameter to compensate for the lack of a sacrificial insert.

Apertured portion 108 is preferably made of a hard abrasion resistant material such as tungsten carbide, although other suitable materials may be employed without departing from the principles of the present invention. Lower portion 114, however, may be made of less costly and less abrasion resistant material than apertured portion 108 for purposes of economy of manufacture of the protective sleeve 106. It is to be understood that apertured portion 108 and lower portion 114 may be made of the same material without departing from the principles of the present invention, in which case there would be no need to separately make each of them and secure them together at interface 118.

Through extensive testing, applicants have found that the variously shaped apertures 112 may be configured to "spread" the circumferential abrasion wear of the protective sleeve 106 longitudinally. As described hereinabove in relation to the protective sleeve 58 of FIG. 1, the greatest amount of abrasion wear due to radially directed slurry flow through a longitudinally extending slotted flow port 74 is typically on the most longitudinally downward portion of the flow port exposed to the radially directed slurry flow. For this reason, on protective sleeve 106 the most longitudinally downward apertures 122 are relatively small in flow area, and the most longitudinally upward apertures 124 are relatively large in flow area. The remainder of the apertures 112, between the farthest upward apertures 124 and the farthest downward apertures 122, are sized such that they are progressively smaller in flow area as they are progressively downwardly disposed on the protective sleeve 106. Note that, in the protective sleeve 106 representatively illustrated in FIG. 5, apertures 126 are similarly sized and apertures 128 are also similarly sized. It is to be understood that various shapes (e.g. slots, circles, ellipses, etc.), dimensions, flow areas, quantity, and spacings of the apertures 112 may be employed without departing from the principles of the present invention.

Apertures 112 formed in protective sleeve 106 are inclined with respect to centerline 130 at an approximate 30 degree included angle. This inclination of the apertures 112 acts to induce a longitudinally downward component to the radially outward directed slurry flow as it passes through the apertures. Benefits to be derived from inducing the longitudinally downward component to the radially outward directed slurry flow will be more clearly understood when the written description relating to FIG. 8 hereinbelow is read and appreciated. Briefly stated, the longitudinally downward component of the slurry flow minimizes direct impingement of the radially directed slurry flow on any equipment disposed radially outward from the exit ports 56 of the crossover 22 (see FIG. 6). It is to be understood that other inclination angles of the apertures 112, may be employed without departing from the principles of the present invention. Additionally, apertures 112 may be sloped tangentially to induce a tangential component to the slurry flow.

An additional benefit derived from the progressively larger flow area of the apertures 112 as the apertures are upwardly disposed in the columns 110, is that slurry flow exiting more upwardly disposed larger flow area apertures influences the slurry flow exiting more downwardly disposed smaller flow area apertures. Therefore, the longitudinally downward component of the slurry flow exiting the more longitudinally upwardly disposed larger flow area apertures aids in inducing the longitudinally downward component to the slurry flow exiting more longitudinally downwardly disposed apertures, thereby enhancing the benefit of the longitudinally downward component of the radially directed slurry flow described hereinabove.

Turning now to FIG. 6, the apparatus 10 is representatively illustrated having the protective sleeve 106 operatively disposed therein. Note that in the embodiment shown in FIG. 6 there is no sacrificial insert disposed within the protective sleeve 106.

Interiorly disposed within the inner diameter 70 of lower portion 114 above the upper portion 24 of plug 26 is a slurry well 132. This slurry well 132 has the same function as the slurry well 78 representatively illustrated in FIG. 1.

The apertures 122,124,126, and 128 are circumferentially and longitudinally aligned with the exit ports 56 of the crossover 22 and the protective sleeve 106 completely interiorly overlaps the inner diameter 64 of the crossover. Note that a portion 134 of the protective sleeve 106 circumferentially disposed between the lowermost apertures 122 and the exit ports 56 is thicker circumferentially than a portion 136 of the protective sleeve circumferentially disposed between the apertures 128 and the exit ports, which is, similarly, thicker circumferentially than portion 138 circumferentially disposed between apertures 124 and 126 and the exit ports. Thus, corresponding to a smaller circumferential width of the apertures 112 more longitudinally downwardly disposed on the protective sleeve 106 are progressively increased circumferential thicknesses available for abrasion wear thereof.

Figure 7:
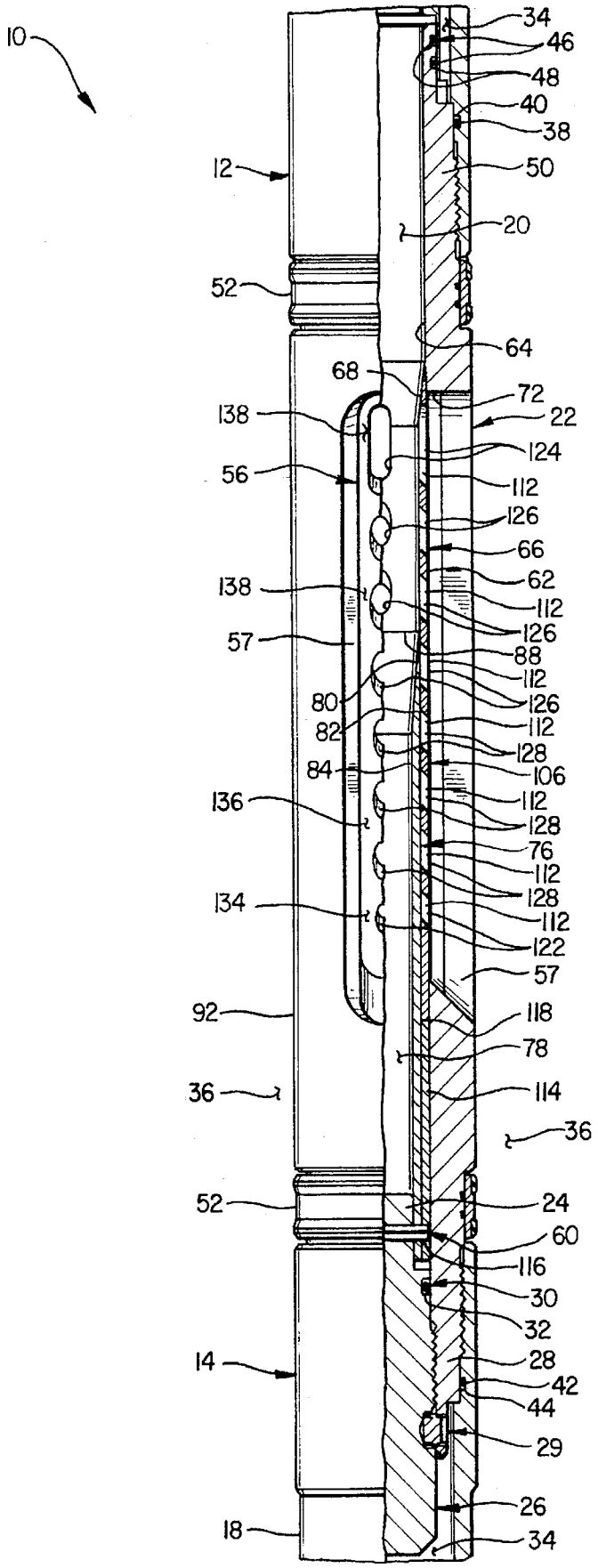
FIG. 7 is a partially cross-sectional view of the slurry delivery apparatus having the somewhat modified tubular protective sleeve of FIG. 5 and the tubular sacrificial insert of FIG. 1 operatively installed therein.

Turning now to FIG. 7, the apparatus 10 is representatively illustrated as having the sacrificial insert 76 of FIG. 1 operatively disposed coaxially within the protective sleeve 106. Lower portion 114 of the protective sleeve 106 has been somewhat modified to accept the insert 76 therewithin by eliminating the radially reduced inner diameter portion 120 so that inner diameter 70 extends longitudinally therethrough. Slurry well 78 is now disposed within the insert 76 in place of slurry well 132 (see FIG. 6) in the protective sleeve 106. With the insert 76 in protective sleeve 106, circumferential abrasion wear of the protective sleeve is "spread" longitudinally downward as the insert is worn away. Thus it may be clearly seen that the protective sleeve 106 may be utilized with sacrificial insert 76, or alternatively, sacrificial inserts 94 (see FIG. 4A), 102 (see FIG. 4B), or others without departing from the principles of the present invention.

Figure 8:
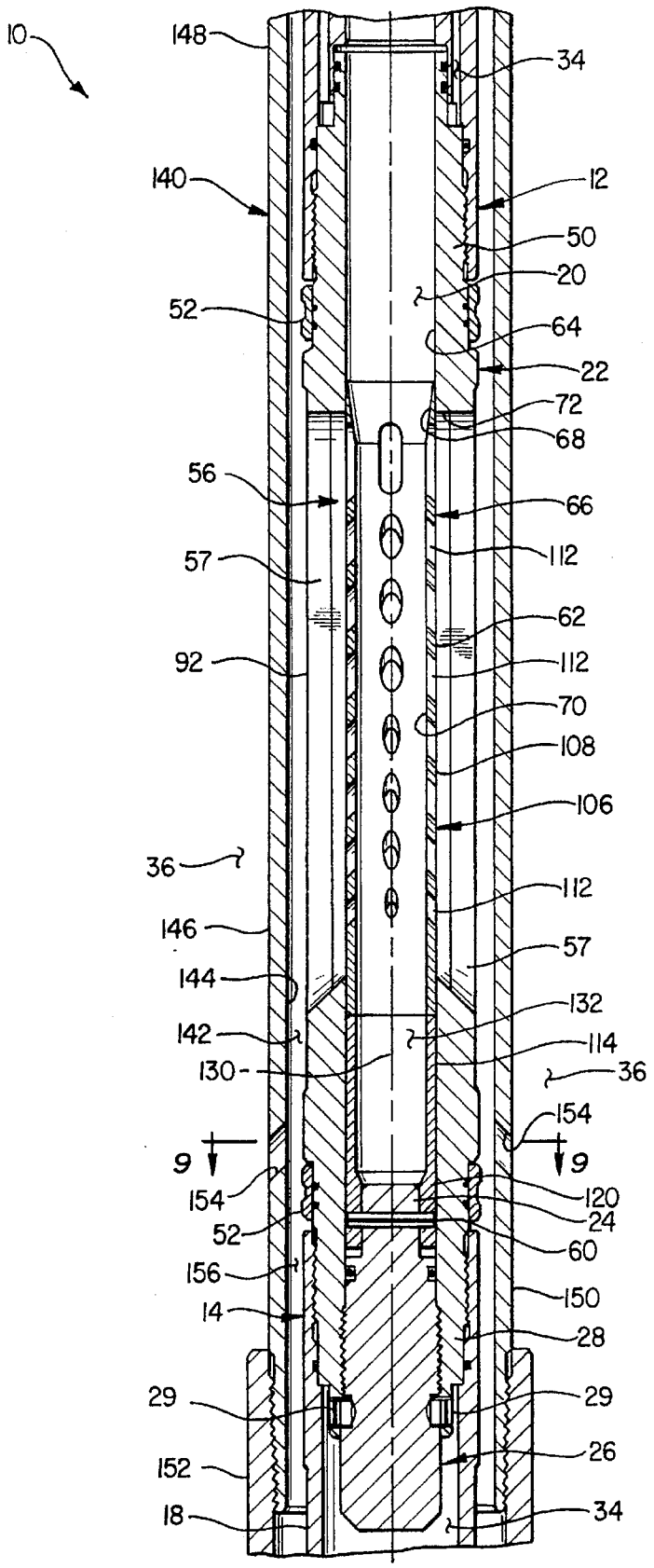
FIG. 8 is a cross-sectional view of the slurry delivery apparatus of FIG. 6, further having a casing protective flow sub.

FIG. 8 shows the apparatus 10 having a coaxially disposed outer tubular flow sub 140 completely exteriorly overlapping the crossover 22. An annular flow area 142 is thereby formed radially between the outer diameter 92 of the crossover 22 and inner diameter 144 of the flow sub 140. Outer diameter 146 of the flow sub 140 is exposed to the wellbore 36.

An upper portion 148 of the flow sub 140 extends longitudinally upward and is suspended from the packer (not shown). A lower portion 150 of the flow sub 140 is threadedly secured to a lower connector 152 from which further equipment may be attached and suspended.

Extending radially through the flow sub 140 and providing fluid communication from the annular flow area 142 to the wellbore 36 are six circumferentially spaced slurry ports 154 (only two of which are visible in FIG. 8). Slurry ports 154 are inclined with respect to the centerline 130 at a 45 degree included angle in order to induce a longitudinally downward component to the radially directed slurry flow as it exits the slurry ports.

The inclination of the slurry ports 154 acts to reduce direct impingement of the radially directed slurry flow on any equipment external to the flow sub 140. In particular, the inclination of the slurry ports 154 reduces abrasion wear of the casing (see FIG. 10 and accompanying written description). It is to be understood that other inclination angles of the slurry ports 154 with respect to the centerline 130 may be utilized without departing from the principles of the present invention. It is also understood that the slurry ports may be used in a closing sleeve assembly instead of a flow sub.

Slurry ports 154 are longitudinally downwardly displaced relative to the exit ports 56 in the crossover 22 such that the slurry cannot flow directly radially outward from the exit ports 56 and through the slurry ports 154. The slurry must flow, after exiting exit ports 56, at least partially longitudinally downward through annular flow area 142 before it may flow radially outward through slurry ports 154. Thus, the slurry is made to impinge upon the inner diameter 144 of the flow sub 140 after the slurry exits the exit ports 56.

An annular slurry well 156 is longitudinally downwardly disposed relative to the slurry ports 154. Annular slurry well 156 performs a function similar to that performed by slurry well 132 within protective sleeve 106 and by slurry well 78 within sacrificial insert 76 (see FIG. 1). Soon after the slurry flow commences, annular slurry well 156 will fill with the slurry material and provide a fluid "cushion" for the longitudinally downward flow of the slurry in the annular flow area 142.

Flow sub 140 is preferably made of an abrasion resistant material. Since the slurry flow impinges upon the inner diameter 144 of the flow sub 140 before exiting the slurry ports 154, the inner diameter 144 is particularly susceptible to abrasion wear therefrom. For this reason, the flow sub 140 is preferably made of an alloy steel and surfaced hardened at least on the inner diameter 144 by a nitriding or carburizing treatment. It is to be understood that other materials and surface treatments may be utilized without departing from the principles of the present invention.

Figure 9:
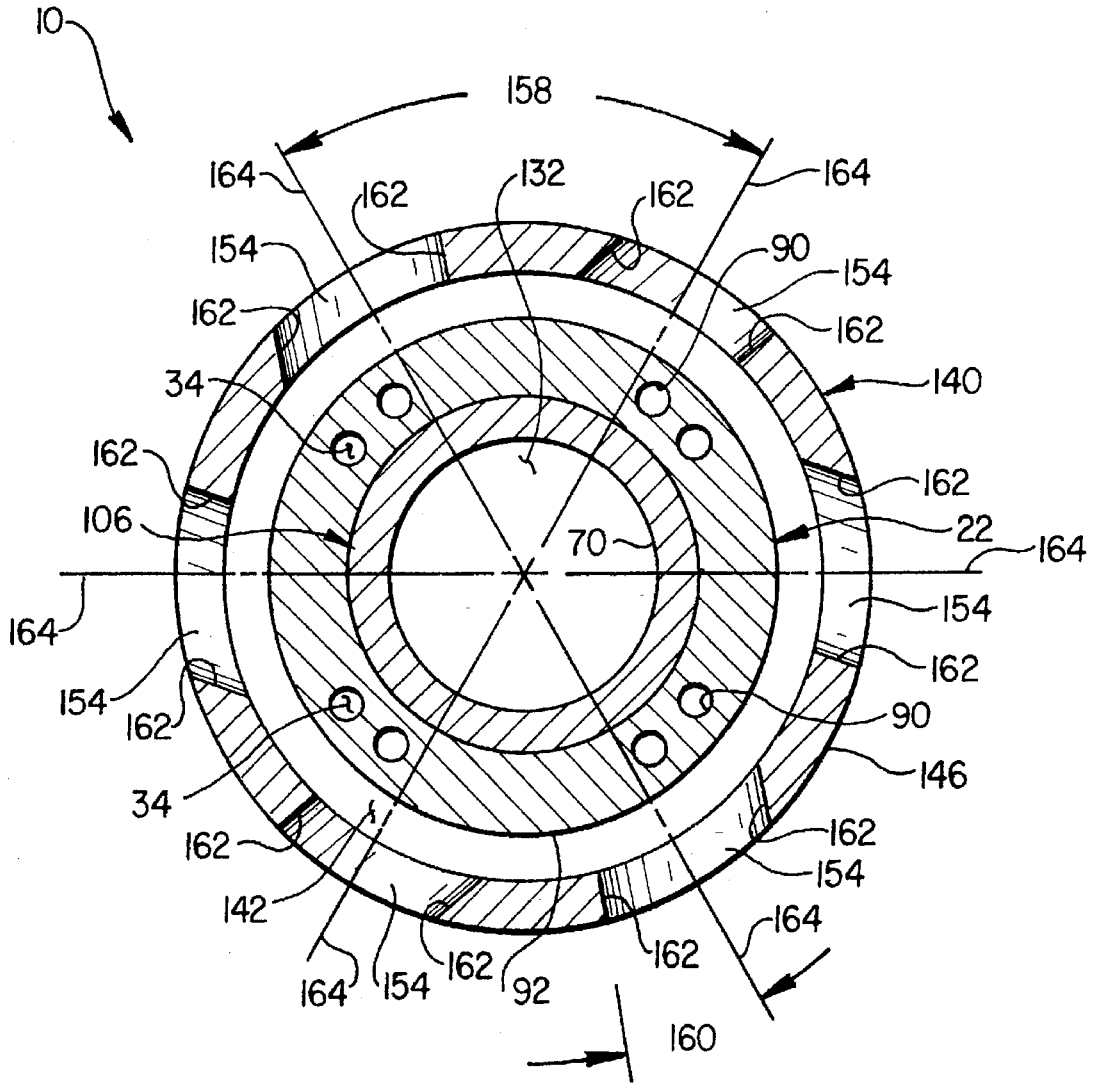
FIG. 9 is an enlarged cross-sectional view of the slurry delivery apparatus taken along line 9—9 of FIG. 8.

Turning now to FIG. 9, a cross-sectional view of the apparatus 10 may be seen, taken along the line 9-9 in FIG. 8 which extends laterally through the slurry ports 154 of the flow sub 140. In this view all six of the slurry ports 154 are visible. The slurry ports 154 are equally circumferentially spaced at an angle 158 of 60 degrees. It is to be understood that different quantities and circumferential spacings of the slurry ports 154 may be employed without deviating from the principles of the present invention.

A unique orientation of the slurry ports 154 within the flow sub 140 contributes to a reduction in abrasion wear of the casing external to the flow sub. The inclination of the slurry ports 154 with respect to the centerline 130 has been described hereinabove in the written description accompanying FIG. 8. Additionally, slurry ports 154 are tangentially angled such that a 25 degree included angle 160 is formed between circumferential edges 162 of the slurry ports 154 and radially extending reference lines 164. This tangentially sloped configuration of the slurry ports 154 induces a tangential component to the slurry flow as it exits the slurry ports 154. It is to be understood that other angles of tangential slope may be utilized for the slurry ports 154 without deviating from the principles of the present invention.

In combination with the longitudinally downward component induced by the downward inclination of the slurry ports 154, the tangential component thus induced to the slurry flow produces a downwardly directed helical flowpath of the slurry. This helical flowpath further acts to reduce the abrasion wear of the slurry on any equipment external to the flow sub 140, in particular the casing surrounding the flow sub 140 (see FIG. 10 and accompanying description).

Turning now to FIG. 10, the slurry delivery apparatus 10 may be seen operatively disposed in the wellbore 36 which is lined longitudinally and circumferentially with protective casing 162. In the embodiment representatively illustrated in FIG. 10, flow sub 140 is divided into an upper portion 164 and a lower portion 166.

Flow sub upper portion 164 is specially adapted to contain and position five annular wear rings 168. Upper portion 164 maintains the wear rings 168 longitudinally opposite and exteriorly overlapping the exit ports 56 of the crossover 22. The wear rings 168 are disposed in an annular recess disposed radially inwardly from an enlarged inner diameter 170, and longitudinally between shoulder 172 interiorly formed on upper portion 164 and upper end 174 of lower portion 166. The wear rings 168 are inserted into upper portion 164 before it is threadedly attached to lower portion 166.

Wear rings 168 are preferably made of an abrasion resistant material such as tungsten carbide or a through-hardened alloy steel. The purpose of the wear rings 168 is to prevent abrasion wear of the flow sub 140 inner diameter 144 by preventing impingement of the slurry on the inner diameter 144. It is to be understood that other suitably hard and tough abrasion resistant materials may be utilized without departing from the principles of the present invention.

Flow sub lower portion 166 includes slurry ports 154 and is threadedly attached to lower connector 152. The slurry ports 154 formed in lower portion 166 are inclined to direct the slurry flow tangentially and longitudinally downward as described hereinabove in relation to FIGS. 8 and 9.

Dashed line 176 indicates schematically the slurry flowpath from the time it enters the axial flow passage 20 of the apparatus 10 until it exits the slurry ports 154 of the flow sub lower portion 166. The term "upstream" shall be used hereinbelow to indicate directions toward the entrance of the flowpath 176, and the term "downstream" shall be used to indicate directions toward the exit of the flowpath 176. Thus, upper connector 12 is upstream of lower portion 166. As the apparatus 10 is representatively illustrated in FIG. 10, the downstream direction is longitudinally downward.

Slurry flowpath 176 enters the apparatus 10 through axial flow passage 20 in upper connector 12. The flowpath 176 then enters the crossover 22 and protective sleeve 106. Portion 178 of flowpath 176 is substantially longitudinal and downwardly directed as viewed in FIG. 10. Cushioned by slurry well 132, the flowpath 176 must next change direction in order to radially exit apertures 112 formed in protective sleeve 106.

The 30 degree inclination of apertures 112 induces a longitudinally downward component to the radially outwardly directed slurry flow, resulting in a downwardly inclined flowpath portion 180 of slurry flowpath 176. Downstream of the crossover exit ports 56, flowpath portion 180 enters annular flow area 142 and then impinges upon wear rings 168. Note that this is not a radially orthogonal impingement, but an oblique impingement which is less abrasive to the wear rings 168. Note, also, that the flow sub 140, being positioned longitudinally opposite the exit ports 56, and radially between the exit ports and the casing 162, thereby protects the casing from impingement by the flowpath portion 180.

Since slurry ports 154 are displaced longitudinally downward relative to exit ports 56, the slurry flowpath 176 must then travel longitudinally downward in annular flow area 142 as indicated by flowpath portion 182. Cushioned by slurry well 156, the slurry flowpath 176 must then change direction yet again in order to radially exit slurry ports 154.

As the slurry flowpath 176 travels downstream through slurry ports 154, as indicated by flowpath portion 184, both tangentially directed and longitudinally directed components are induced on the flow, resulting in a helical downwardly directed flow. Thus, downstream of slurry ports 154, flowpath portion 184 is flowing radially outward, tangentially with respect to the wellbore 36, and longitudinally downward.

Flowpath portion 184 impinges upon the casing 162 obliquely, resulting in greatly reduced abrasion wear thereof. Its radial component thereby eliminated, slurry flowpath 176 next travels helically downward as indicated by flowpath portion 186 in the wellbore 36.

The foregoing detailed description is to be clearly understood as being given by way of illustration and example only, the spirit and scope of the present invention being limited solely by the appended claims.

What is claimed is:

1. Abrasive slurry delivery apparatus operatively positionable in a subterranean wellbore, comprising:

a first tubular structure having an internal flow passage through which a pressurized, abrasive slurry material may be axially flowed in a downstream direction, and an axial portion having a side wall section with an outlet opening therein through which an abrasive slurry material may be outwardly discharged from said internal flow passage, said outlet opening being circumscribed by a peripheral edge portion of said side wall section; and shielding for protecting said peripheral edge portion of said side wall section from abrasive slurry material being discharged outwardly through said outlet opening, said shielding being disposed within said axial portion of said first tubular structure and having a peripheral edge portion that inwardly overlaps said peripheral edge portion of said side wall section and inwardly blocks a peripheral portion of said outlet opening, said shielding including a tubular sleeve member formed from a material having a substantially higher abrasive wear resistance than that of said first tubular structure, said tubular sleeve member being coaxially received within said axial portion of said first tubular structure and having an inner side surface, and an outer side surface contiguous with the inner side surface of said axial portion, and a side wall portion having disposed therein an outlet opening generally aligned with, but being smaller than and inset from essentially the entire periphery of, said outlet opening in said axial portion of said first tubular structure, said outlet opening in said side wall portion having a peripheral surface extending between said inner and outer side surfaces of said tubular sleeve member and being essentially entirely exposed to abrasive slurry flow through said outlet opening of said side wall portion.

2. The abrasive slurry delivery apparatus of claim 1 wherein:

said axial portion of said first tubular structure is a tubular crossover member.

3. The abrasive slurry delivery apparatus of claim 1 wherein:

said shielding is replaceable and is removably supported within said axial portion of said first tubular structure.

4. The abrasive slurry delivery apparatus of claim 1 wherein:

said outlet openings in said tubular sleeve member and said axial portion of said first tubular structure are axially elongated outlet openings.

5. The abrasive slurry delivery apparatus of claim 1 wherein:

said tubular sleeve member has an upstream end portion positioned to receive abrasive slurry being axially forced in said downstream direction through said internal flow passage in said first tubular structure, said upstream end portion having an interior side surface that tapers radially inwardly in a downstream direction, and at least a portion of said outlet opening in said tubular sleeve member extends through said interior side surface of said upstream end portion of said tubular sleeve member.

6. The abrasive slurry delivery apparatus of claim 1 wherein:

said tubular sleeve member has an axially spaced series of outlet openings formed in said side wall portion thereof, said axially spaced series of outlet openings being inwardly offset from the periphery of said outlet opening in said side wall section of said axial portion of said first tubular structure, with said outlet opening in said side wall section of said axial portion of said first tubular structure communicating with said internal flow passage through said spaced series of outlet openings.

7. The abrasive slurry delivery apparatus of claim 1 further comprising:

an insert, received within said shielding, for controlling slurry outflow abrasion wear on said peripheral edge portion of said shielding in a manner such that said slurry outflow abrasion wear initiates on an upstream part of said peripheral edge portion of said shielding and then spreads in a downstream direction therealong.

8. The abrasive slurry delivery apparatus of claim 7 wherein:

said shielding include a tubular sleeve member coaxially received within said axial portion of said first tubular structure and having an outer side surface contiguous with the inner side surface of said axial portion, and a side wall portion having disposed therein an outlet opening having upstream and downstream ends and being generally aligned with, but smaller than and inset from said peripheral edge portion of, said outlet opening in said axial portion of said first tubular structure, and said insert including a cylindrical sacrificial insert member coaxially received in said tubular sleeve member and having an upstream end positioned downstream from said upstream end of said outlet opening in said side wall portion of said tubular sleeve member, and a downstream end positioned downstream from said downstream end of said outlet opening in said side wall portion of said tubular sleeve member.

9. The abrasive slurry delivery apparatus of claim 8 wherein:

said sacrificial insert member is of a solid cylindrical configuration.

10. The abrasive slurry delivery apparatus of claim 8 wherein:

said sacrificial insert member is of a hollow tubular configuration with said upstream end thereof being open and said downstream end thereof being closed, whereby the interior of said sacrificial insert member forms a well for receiving and containing a quantity of abrasive slurry material.

11. The abrasive slurry delivery apparatus of claim 1 wherein:

said outlet opening in said tubular sleeve member is sloped radially outwardly in a downstream direction.

12. Abrasive slurry delivery apparatus operatively positionable in a subterranean wellbore, comprising:

a first tubular structure having an internal flow passage through which a pressurized, abrasive slurry material may be axially flowed in a downstream direction, and an axial portion having a side wall section with an outlet opening therein through which an abrasive slurry material may be outwardly discharged from said internal flow passage, said outlet opening being circumscribed by a peripheral edge portion of said side wall section; and shielding for protecting said peripheral edge portion of said side wall section from abrasive slurry material being discharged outwardly through said outlet opening, said shielding being disposed within said axial portion of said first tubular structure and having a peripheral edge portion that inwardly overlaps said peripheral edge portion of said side wall section and inwardly blocks a peripheral portion of said outlet opening, said shielding including a tubular sleeve member coaxially received within said axial portion of said first tubular structure and having an outer side surface contiguous with the inner side surface of said axial portion, and a side wall portion having disposed therein an outlet opening generally aligned with, but being smaller than and inset from the periphery of, said outlet opening in said axial portion of said first tubular structure, said tubular sleeve member having an axially spaced series of outlet openings formed in said side wall portion thereof, said axially spaced series of outlet openings being inwardly offset from the periphery of said outlet opening in said side wall section of said axial portion of said first tubular structure, with said outlet opening in said side wall section of said axial portion of said first tubular structure communicating with said internal flow passage through said spaced series of outlet openings, said spaced series of outlet openings progressively decreasing in area in said downstream direction.

13. Abrasive slurry delivery apparatus operatively positionable in a subterranean wellbore, comprising:

a first tubular structure having an internal flow passage through which a pressurized, abrasive slurry material may be axially flowed in a downstream direction, said first tubular structure having an axial portion with a side wall section thereon;

a first port, associated with said first tubular structure side wall section and operative to discharge abrasive slurry material from said internal flow passage outwardly from said first tubular structure;

a second tubular structure coaxially and outwardly circumscribing said axial portion of said first tubular structure and forming therewith an annular flow passage that circumscribes said axial portion, said second tubular structure having a side wall section spaced apart from said first port in said downstream direction; and a second port formed in said second tubular structure side wall section, said annular flow passage and said second port cooperating to cause abrasive slurry being outwardly discharged from said first port to flow in a downstream direction through said annular flow passage before being discharged outwardly through said second port, said first port being operative to discharge abrasive slurry material therefrom along a path sloped radially outwardly in a downstream direction, and said second port being operative to discharge abrasive slurry material therefrom along a path (1) sloped radially outwardly in a downstream direction and (2) further sloped tangentially in a radially outward direction.

14. The abrasive slurry delivery apparatus of claim 13 wherein:

said axial portion of said first tubular structure is a tubular crossover member, and said second tubular structure is a tubular flow sub member.

15. The abrasive slurry delivery apparatus of claim 13 further comprising:

a wear resistant structure interiorly carried on said second tubular structure and positioned to be impinged upon by abrasive slurry material being discharged from said first port into said annular flow passage.

16. The abrasive slurry delivery apparatus of claim 13 wherein:

said second tubular structure has a downstream end portion disposed downstream from said second port, and said abrasive slurry delivery apparatus further comprises wall means for closing off said annular flow passage at said downstream end portion to form from an axial portion of said annular flow passage downstream from said second port a well area for receiving abrasive slurry material discharged from said first port.

17. The abrasive slurry delivery apparatus of claim 13 wherein:

said axial portion of said first tubular structure is a tubular crossover member, and said second tubular structure is a closing sleeve assembly.

18. Abrasive slurry delivery apparatus operatively positionable in a subterranean wellbore, comprising:

a first tubular structure having an internal flow passage through which a pressurized, abrasive slurry material may be axially flowed in a downstream direction, said first tubular structure having an axial portion with a side wall section thereon;

a first port, associated with said first tubular structure side wall section and operative to discharge abrasive slurry material from said internal flow passage outwardly from said first tubular structure;

a second tubular structure coaxially and outwardly circumscribing said axial portion of said first tubular structure and forming therewith an annular flow passage that circumscribes said axial portion, said second tubular structure having a side wall section spaced apart from said first port in said downstream direction; and a second port formed in said second tubular structure side wall section, said annular flow passage and said second port cooperating to cause abrasive slurry being outwardly discharged from said first port to flow in a downstream direction through said annular flow passage before being discharged outwardly through said second port, said second port being operative to discharge abrasive slurry material therefrom along a path sloped radially outwardly in a downstream direction and further sloped tangentially in a radially outward direction, said first port including means for defining an axially spaced series of openings associated with said first tubular structure side wall section, said series of openings decreasing in size in said downstream direction and operating to cause abrasive slurry being discharged from a first one of said series of openings to impinge upon abrasive slurry being discharged from a second one of said series of openings, positioned downstream from said first one of said series of openings, in a manner increasing the downstream axial directional slope of the abrasive slurry material being discharged from said second one of said series of openings.

19. Abrasive slurry delivery apparatus operatively positionable in a subterranean wellbore, comprising:

a first tubular structure having an internal flow passage through which a pressurized, abrasive slurry material may be axially flowed in a downstream direction, said first tubular structure having an axial portion with a side wall section thereon;

a first port, associated with said first tubular structure side wall section and operative to discharge abrasive slurry material from said internal flow passage outwardly from said first tubular structure;

a second tubular structure coaxially and outwardly circumscribing said axial portion of said first tubular structure and forming therewith an annular flow passage that circumscribes said axial portion, said second tubular structure having a side wall section spaced apart from said first port in said downstream direction;

a second port formed in said second tubular structure side wall section, said annular flow passage and said second port cooperating to cause abrasive slurry being outwardly discharged from said first port to flow in a downstream direction through said annular flow passage before being discharged outwardly through said second port; and a wear resistant structure interiorly carried on said second tubular structure and positioned to be impinged upon by abrasive slurry material being discharged from said first port into said annular flow passage, an interior side surface of said second tubular structure having an annular recess formed therein and outwardly circumscribing said first port, and said wear resistant structure including an axially stacked plurality of annularly shaped wear resistant ring members coaxially carried within said annular recess.

20. Abrasive slurry delivery apparatus operatively positionable in a subterranean wellbore, comprising:

a first tubular structure having an internal flow passage through which a pressurized, abrasive slurry material may be axially allowed in a downstream direction, and an axial portion having a side wall section with a circumferentially spaced plurality of axially elongated first outlet slots disposed therein and through which an abrasive slurry material may be outwardly discharged from said internal flow passage, each of said first outlet slots having upstream and downstream ends and being circumscribed by a peripheral edge portion of said side wall section;

a tubular protective sleeve coaxially and replaceably supported in said axial portion of said first tubular structure and having a circumferentially spaced plurality of axially elongated second outlet slots disposed therein and generally aligned with said first outlet slots, said second outlet slots being smaller than said first outlet slots and being bounded by side wall peripheral edge portions that inwardly overlap said peripheral edge portions of said first tubular structure side wall section, whereby said side wall peripheral edge portions of said tubular protective sleeve inwardly shield said peripheral edge portions of said first tubular structure site wall section from impingement by abrasive slurry material being discharged through said first outlet slots; and a hollow tubular sacrificial insert member coaxially disposed in said axial portion of said first tubular structure and having an open upstream end axially disposed between said upstream and downstream ends of said first outlet slots, and a closed downstream end disposed downstream from said downstream ends of said first outlet slots.

21. The abrasive slurry delivery apparatus of claim 20 wherein:

said tubular protective sleeve has an upstream end portion positioned to receive abrasive slurry being axially forced in said downstream direction through said internal flow passage in said first tubular structure, said upstream end portion having an interior side surface that tapers radially inwardly in a downstream direction, and upstream end portions of said first outlet slots are disposed in said upstream end portion of said tubular protective sleeve.

22. The abrasive slurry delivery apparatus of claim 20 further comprising:

a second tubular structure coaxially receiving said first tubular structure and forming therearound an annular flow passage that communicates with said internal flow passage through said first and second outlet slots, said second tubular structure having a side wall section axially offset from said first outlet slots in a downstream direction and having formed therein a circumferentially spaced plurality of abrasive slurry outlet openings operative to outwardly discharge abrasive slurry material discharged from said first outlet slots and flowing in said downstream direction through said annular flow passage.

23. Abrasive slurry delivery apparatus operatively positionable in a subterranean wellbore, comprising:

a first tubular structure having an internal flow passage through which a pressurized, abrasive slurry material may be axially flowed in a downstream direction, and an axial portion having a side wall section with a circumferentially spaced plurality of axially elongated first outlet slots disposed therein and through which an abrasive slurry material may be outwardly discharged from said internal flow passage, each of said first outlet slots having upstream and downstream ends and being circumscribed by a peripheral edge portion of said side wall section;

a tubular protective sleeve coaxially and replaceably supported in said axial portion of said first tubular structure and having a circumferentially spaced plurality of axially elongated second outlet slots disposed therein and generally aligned with said first outlet slots, said second outlet slots being smaller than said first outlet slots and being bounded by side wall peripheral edge portions that inwardly overlap said peripheral edge portions of said first tubular structure side wall section, whereby said side wall peripheral edge portions of said tubular protective sleeve inwardly shield said peripheral edge portions of said first tubular structure side wall section from impingement by abrasive slurry material being discharged through said first outlet slots; and a solid cylindrical sacrificial insert member coaxially disposed in said axial portion of said first tubular structure and having an upstream end axially disposed between said upstream and downstream ends of said first outlet slots, and a downstream end disposed downstream from said downstream ends of said first outlet slots.

24. The abrasive slurry delivery apparatus of claim 23 wherein:

said tubular protective sleeve has an upstream end portion positioned to receive abrasive slurry being axially forced in said downstream direction through said internal flow passage in said first tubular structure, said upstream end portion having an interior side surface that tapers radially inwardly in a downstream direction, and upstream end portions of said first outlet slots are disposed in said upstream end portion of said tubular protective sleeve.

25. The abrasive slurry delivery apparatus of claim 23 further comprising:

a second tubular structure coaxially receiving said first tubular structure and forming therearound an annular flow passage that communicates with said internal flow passage through said first and second outlet slots, said second tubular structure having a side wall section axially offset from said first outlet slots in a downstream direction and having formed therein a circumferentially spaced plurality of abrasive slurry outlet openings operative to outwardly discharge abrasive slurry material discharged from said first outlet slots and flowing in said downstream direction through said annular flow passage.

26. Abrasive slurry delivery apparatus operatively positionable in a subterranean wellbore, comprising:

a first tubular structure having an internal flow passage through which a pressurized, abrasive slurry material may be axially flowed in a downstream direction, said first tubular structure having an axial portion with a side wall section thereon, said side wall section having disposed thereon a circumferentially spaced plurality of first outlet openings through which abrasive slurry material may be outwardly discharged from said internal flow passage;

a tubular protective sleeve coaxially and replaceably supported in said axial portion of said first tubular structure and having a circumferentially spaced plurality of axially spaced series of second outlet openings, each of said series of second outlet openings being circumferentially and axially aligned and inset from a different one of said first outlet openings, said second outlet openings in each axially spaced series thereof progressively decreasing in area in a downstream direction.

27. Abrasive slurry delivery apparatus operatively positionable in a subterranean wellbore, comprising:

a first tubular structure having an internal flow passage through which a pressurized, abrasive slurry material may be axially flowed in a downstream direction, said first tubular structure having an axial portion with a side wall section thereon, said side wall section having disposed thereon a circumferentially spaced plurality of first outlet openings through which abrasive slurry material may be outwardly discharged from said internal flow passage;

a tubular protective sleeve coaxially and replaceably supported in said axial portion of said first tubular structure and having a circumferentially spaced plurality of axially spaced series of second outlet openings, each of said series of second outlet openings being circumferentially and axially aligned and inset from a different one of said first outlet openings; and a second tubular structure coaxially and outwardly circumscribing said axial portion of said first tubular structure and forming therewith an annular flow passage that circumscribes said axial portion, said second tubular structure having a side wall section spaced axially apart in said downstream direction from said first outlet openings, said second tubular structure side wall section having a circumferentially spaced plurality of third outlet openings therein through which abrasive slurry material being discharged into said annular flow passage from said first outlet openings may be outwardly discharged.

28. The abrasive slurry delivery apparatus of claim 27 wherein:

each of said third outlet openings is radially outwardly sloped in a downstream direction, and is also tangentially sloped in a radially outward direction.

29. The abrasive slurry delivery apparatus of claim 28 wherein:

each of said second outlet openings is radially outwardly sloped in a downstream direction.

30. The abrasive slurry delivery apparatus of claim 27 further comprising:

a wear resistant structure interiorly carried on said second tubular structure and positioned to be impinged upon by abrasive slurry material being discharged from said first outlet openings into said annular flow passage.

31. The abrasive slurry delivery apparatus of claim 30 wherein:

an interior side surface of said second tubular structure has an annular recess formed therein and outwardly circumscribing said first outlet openings, and said wear resistant structure includes an axially stacked plurality of annularly shaped wear resistant ring members coaxially carried within said annular recess.

32. The abrasive slurry delivery apparatus of claim 27 wherein:

said second tubular structure has a downstream end portion disposed downstream from said third outlet openings, and said abrasive slurry delivery apparatus further comprises wall means for closing off said annular flow passage at said downstream end portion to form from an axial portion of said annular flow passage downstream from said third outlet openings a well area for receiving abrasive slurry material discharged from said first outlet openings and forced through said annular flow passage in said downstream direction.

33. For use in conjunction with an abrasive slurry delivery structure having a first tubular structure with an internal passage through which an abrasive slurry may be axially flowed in a downstream direction, and side wall outlet port bounded by a peripheral side wall edge portion and outwardly through which abrasive slurry material from the internal passage may be discharged, a method of inhibiting slurry erosion of the peripheral side wall edge portion, said method comprising the steps of:

providing a replaceable protective member having a peripheral edge portion;

removably positioning said protective member within the interior of the first tubular structure in a manner such that said peripheral edge portion of said protective member shields the peripheral side wall edge portion of the first tubular structure outlet port from abrasive slurry material being forced outwardly therethrough and is subjected to slurry abrasion in place of the peripheral side wall edge portion of the first tubular structure outlet port, the outlet port of the first tubular structure being defined by a circumferentially spaced plurality of axially elongated outlet slots opening laterally outwardly through the side wall of the first tubular structure, said providing step being performed by providing a hollow tubular protective member having a circumferentially spaced plurality of axially elongated outlet slots opening laterally outwardly through a side wall section thereof, said removably positioning step being performed by coaxially supporting said hollow tubular protective member within the first tubular structure with said axially elongated outlet slots in said hollow tubular protective member being circumferentially and axially aligned with the axially elongated outlet slots in the first tubular structure, and with peripheral side wall portions of said protective member outlet slots inwardly overlying corresponding peripheral side wall portions of the first tubular structure;

providing a solid cylindrical sacrificial member; and positioning said sacrificial member coaxially within said protective member with a first end of said sacrificial member axially disposed between the upstream and downstream ends of the first tubular structure outlet slots, and the second end of said sacrificial member axially disposed downstream of the downstream ends of the first tubular structure outlet slots.

34. For use in conjunction with an abrasive slurry delivery structure having a first tubular structure with an internal passage through which an abrasive slurry may be axially flowed in a downstream direction, and side wall outlet port bounded by a peripheral side wall edge portion and outwardly through which abrasive slurry material from the internal passage may be discharged, a method of inhibiting slurry erosion of the peripheral side wall edge portion, said method comprising the steps of:

providing a replaceable protective member having a peripheral edge portion;

removably positioning said protective member within the interior of the first tubular structure in a manner such that said peripheral edge portion of said protective member shields the peripheral side wall edge portion of the first tubular structure outlet port from abrasive slurry material being forced outwardly therethrough and is subjected to slurry abrasion in place of the peripheral side wall edge portion of the first tubular structure outlet port, the outlet port of the first tubular structure being defined by a circumferentially spaced plurality of axially elongated outlet slots opening laterally outwardly through the side wall of the first tubular structure, said providing step being performed by providing a hollow tubular protective member having a circumferentially spaced plurality of axially elongated outlet slots opening laterally outwardly through a side wall section thereof, said removably positioning step being performed by coaxially supporting said hollow tubular protective member within the first tubular structure With said axially elongated outlet slots in said hollow tubular protective member being circumferentially and axially aligned with the axially elongated outlet slots in the first tubular structure, and with peripheral side wall portions of said protective member outlet slots inwardly overlying corresponding peripheral side wall portions of the first tubular structure;

providing a hollow tubular sacrificial member having an open first end and a closed second end; and positioning said sacrificial member coaxially within said protective member with said open first end of said sacrificial member facing in an upstream direction and being axially disposed between upstream and downstream ends of the first tubular structure outlet slots, and said closed second end being disposed downstream of the downstream ends of the first tubular structure outlet slots.

35. For use in conjunction with an abrasive slurry delivery structure having a first tubular structure With an internal passage through which an abrasive slurry may be axially flowed in a downstream direction, and side wall outlet port bounded by a peripheral side wall edge portion and outwardly through which abrasive slurry material from the internal passage may be discharged, a method of inhibiting slurry erosion of the peripheral side wall edge portion, said method comprising the steps of:

providing a replaceable protective member having a peripheral edge portion; and removably positioning said protective member within the interior of the first tubular structure in a manner such that said peripheral edge portion of said protective member shields the peripheral side wall edge portion of the first tubular structure outlet port from abrasive slurry material being forced outwardly therethrough and is subjected to slurry abrasion in place of the peripheral side wall edge portion of the first tubular structure outlet port, the outlet port of the first tubular structure being defined by a circumferentially spaced plurality of axially elongated outlet slots opening laterally outwardly through the side wall of the first tubular structure, said providing step being performed by providing a hollow tubular protective member having a circumferentially spaced plurality of series of axially spaced side wall outlet openings, and said removably positioning step being performed by coaxially supporting said hollow tubular protective member within said first tubular structure with each of said series of axially spaced side wall outlet openings being aligned with and opening outwardly through a different one of said plurality of axially elongated outlet slots, said providing step being further performed by providing said series of axially spaced side wall outlet openings with the outlet openings in each series thereof progressively decreasing in size in said downstream direction.

36. The method of claim 35 further comprising the step of: configuring each of said outlet openings in said protective member in a manner such that the outlet opening is radially outwardly sloped in said downstream direction.

37. A method of delivering abrasive slurry material to the Anterior of a subterranean wellbore, said method comprising the steps of:

positioning in the wellbore a slurry delivery assembly having a first tubular structure having an internal passage through which an abrasive slurry material may be axially forced in a downstream direction, said first tubular structure having first side wall port communicating with said internal passage and through which pressurized abrasive slurry material may be outwardly discharged from said internal passage, and a second tubular structure coaxially and outwardly circumscribing said first tubular structure and forming therearound an annular flow passage, said second tubular structure having second side wall port positioned downstream from said first side wall port;

forcing a pressurized abrasive slurry sequentially through said internal passage in said downstream direction, outwardly through said first side wall port into said annular flow passage, axially through said annular flow passage in said downstream direction, and then outwardly through said second side wall outlet means; and supporting a protective structure on an interior side surface portion of said second tubular structure for impingement by abrasive slurry material being outwardly discharged through said first side wall port to thereby shield said interior side surface portion from slurry abrasion, said step of supporting a protective structure being performed by forming an annular interior recess in said second tubular structure, and coaxially supporting in said annular recess an axially stacked plurality of wear resistant abrasion protection members.

38. A method of delivering abrasive slurry material to the interior of a subterranean wellbore, said method comprising the steps of:

positioning in the wellbore a slurry delivery assembly having a first tubular structure having an internal passage through which an abrasive slurry material may be axially forced in a downstream direction, said first tubular structure having first side wall port communicating with said internal passage and through which pressurized abrasive slurry material may be outwardly discharged from said internal passage, and a second tubular structure coaxially and outwardly circumscribing said first tubular structure and forming therearound an annular flow passage, said second tubular structure having second side wall port positioned downstream from said first side wall port;

forcing a pressurized abrasive slurry sequentially through said internal passage in said downstream direction, outwardly through said first side wall port into said annular flow passage, axially through said annular flow passage in said downstream direction, and then outwardly through said second side wall outlet means; and configuring said second side wall port in a manner such that abrasive slurry material outwardly discharged therefrom along a path which is sloped radially outwardly in a downstream direction, and is also sloped tangentially in a radially outward direction.

* * * * *